US005865393A

United States Patent [19]

Kreft et al.

[11] Patent Number: 5,865,393

[45] Date of Patent: Feb. 2, 1999

[54] VERTICAL STRIP STORAGE DEVICE

[75] Inventors: Bernd Kreft, Willich; Wilfried Schmidt, Duisburg, both of Germany

[73] Assignee: Mannesmann Aktiengesellschaft, Düsseldorf, Germany

[21] Appl. No.: 974,696

[22] Filed: Nov. 20, 1997

[30] Foreign Application Priority Data

Nov. 26, 1996 [DE] Germany ..... 196 50 997.1

[51] Int. Cl.[6] ..... B65H 20/34

[52] U.S. Cl. ..... 242/417.2; 226/118.2

[58] Field of Search ..... 242/417.2, 417.3, 242/552; 226/118.2, 118.3, 118.1, 104, 105, 106, 107

[56] References Cited

U.S. PATENT DOCUMENTS

| | | | |
|---|---|---|---|
| 3,669,375 | 6/1972 | Bruton | 242/552 |
| 4,223,822 | 9/1980 | Clitheroe | 226/118.3 |

FOREIGN PATENT DOCUMENTS

| | | | |
|---|---|---|---|
| 0 761 582 | 3/1997 | European Pat. Off. | B65H 20/34 |
| 295 21 303 | 1/1997 | Germany | B65H 20/34 |
| 1 415 079 | 11/1975 | United Kingdom | B65H 17/42 |

*Primary Examiner*—John M. Jillions
*Attorney, Agent, or Firm*—Cohen, Pontani, Lieberman & Pavane

[57] ABSTRACT

A vertical strip storage device for bridging strip running interruptions in continuous strip production includes a supporting frame forming a looping tower. The continuous strip is looped around deflecting rollers mounted on upper and lower horizontal roller bridges. The roller bridges move synchronously and vertically, one above the other, toward and away from one another. The inherent weight of one roller bridge compensates for the inherent weight of the other roller bridge as a counterweight. A joint cable drive is used to move the roller bridges. One of the roller bridges is at the upward cable portion of the vertically deflected joint cable drive and the other roller bridge is at the downward cable portion of this vertically deflected joint cable drive. The joint cable drive includes pulley blocks supported in the upper region and in the lower region of the supporting frame. Each pulley block includes stationary rollers connected to the supporting frame and loose rollers connected to the respective roller bridges. A cable of each pulley block is guided to a cable drum such that when the cable drum rotates, the associated roller bridge moves.

4 Claims, 2 Drawing Sheets

VERTICAL STRIP STORAGE DEVICE

BACKGROUND OF THE INVENTION

1. Field of the Invention

The invention is directed to a vertical strip accumulator or strip storage device for bridging interruptions in a continuous strip production, such as, for example, a continuous annealing. The vertical strip storage device comprises a supporting frame which forms a looping tower. The continuous strip is looped around deflecting rollers at upper and lower horizontal roller bridges in the looping tower which are synchronously vertically movable, one above the other, toward and away from one another. The inherent weight of one roller bridge compensates for the inherent weight of the other roller bridge as a counterweight. One roller bridge is always at the upward cable portion of a vertically deflected joint cable drive and the other roller bridge is always at the downward cable portion of this vertically deflected joint cable drive. The joint cable drive includes rollers supported in the upper region and in the lower region of the supporting frame.

2. Description of the Related Art

Vertical strip storage devices of the above-described type are known as loop towers or loopers and are employed in continuous strip production for maintaining continuous process speed during coil handling, such as when changing coils and/or welding the start of the coil to the end of the strip. Long lengths of strip can be stored temporarily in these vertical strip storage devices in that enlarged loops of the strip are guided alternately around upper and lower deflecting rollers of roller bridges. The enlarging of the loops is effected, for example, by moving the upper roller bridge upward in the supporting frame while the lower roller bridge remains stationary, so that the length of strip stored between the roller bridges increases. To move the extremely heavy roller bridge upward, it is known to arrange counterbalances or counterweights laterally outside of the supporting frame. The counterweights are connected with the movable roller bridge by coupling cables or chains via deflecting rollers and compensate for the inherent weight of the movable roller bridge.

However, the known construction has disadvantages including the extreme elaborateness and high cost of materials required for compensating the weight of the movable roller bridge and the very time-consuming and labor-intensive threading of the strip after a breakage of strip, which is inevitable from time to time in such prior art devices. For at least these reasons, an improved vertical strip storage device was proposed in reference DE-U-295 21 303. In the improved strip storage device, both the upper and lower roller bridges are movably guided, one above the other, in the supporting frame so as to be synchronously movable toward and away from each other. In this improved configuration, the inherent weight of one of the roller bridges acts as a counterbalance to compensate for the inherent weight of the other of the roller bridges.

In contrast to previous solutions, rather than moving either the upper roller bridge or the lower roller bridge in the supporting frame, both roller bridges are now guided so as to be synchronously movable, such that the inherent weights of the roller bridges offset one another. This eliminates the considerable cost for counterweight compensation which was required in the prior known solution, which represents savings in the production of the overall plant, even considering the cost of the second movable roller bridge. Moreover, the suggested solution achieves a further advantage in that the roller bridges are moved apart and are moved together at half-speed to effect the same result as the prior known solution because one roller bridge is at the upward portion of vertically deflected cable drives or chain drives which are driven jointly at the same speed and the other roller bridge is at the downward portion of these drives. A halving of the driving speed such as this also enables more economical gearing configurations.

Despite the cost advantages of this improved strip storage device, the drive and cables for moving the roller bridges remain large and costly.

SUMMARY OF THE INVENTION

The object of the present invention is to further improve the generic strip storage device to simplify the configuration of the driving means for the roller bridges wherein the required driving torque is decreased such that the cable pulley diameter and the drive cable diameter can be reduced and the construction of the strip storage device and its supporting frame is simplified for a further reduction in costs in plant production.

This object is attained using a pulley block design for each of the two roller bridges as a traveling drive. An upper pulley block is provided for moving the upper roller bridge and a lower pulley block is provided for moving the lower roller bridge. Each pulley block of the present invention includes stationary rollers and loose rollers. The stationary rollers are arranged at the supporting frame above the upper roller bridge and below the lower roller bridge. The accompanying loose rollers of the upper and lower pulley blocks are fastened LO the upper and lower roller bridges, respectively. Each of the upper and lower pulley blocks has a drive cable connected to a cable drum in the center of the supporting frame.

The driving of the roller bridges by a 12/2-strand pulley block appreciably reduces the driving torque, enabling a cost-saving reduction of the entire system comprising motor, gear unit, and pulley block.

In an advantageous configuration, both cable drums are driven by one motor. Since the torque required is reduced by the pulley blocks, a smaller motor is used for a simplified and more economical drive.

The cable drums are driven by the motor via a differential gear unit. The use of a differential gear unit enables an equal load distribution to the pulley blocks thereby eliminating the requirement for cable tension regulating devices.

In another embodiment of the invention, the cable drums and their driving means are arranged laterally on a bracket at the supporting frame. The supporting frame is constructed as a modular type lattice tower. The modular type construction of the supporting frame enables the use of standard structural component parts. The modular type construction also reduces assembly time by roughly half. The arrangement of the cable drums and drives on the bracket of the supporting frame has the further advantage that no strip tensioning forces or torque need be introduced into the foundation. The support of forces is effected internally via the supporting frame. The appreciable reduction in weight as a result of using a supporting frame in a lattice construction is especially noteworthy.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

An embodiment example of the invention is shown in the drawing and described in the following.

DETAILED DESCRIPTION OF THE PRESENTLY PREFERRED EMBODIMENTS

Figure 1:
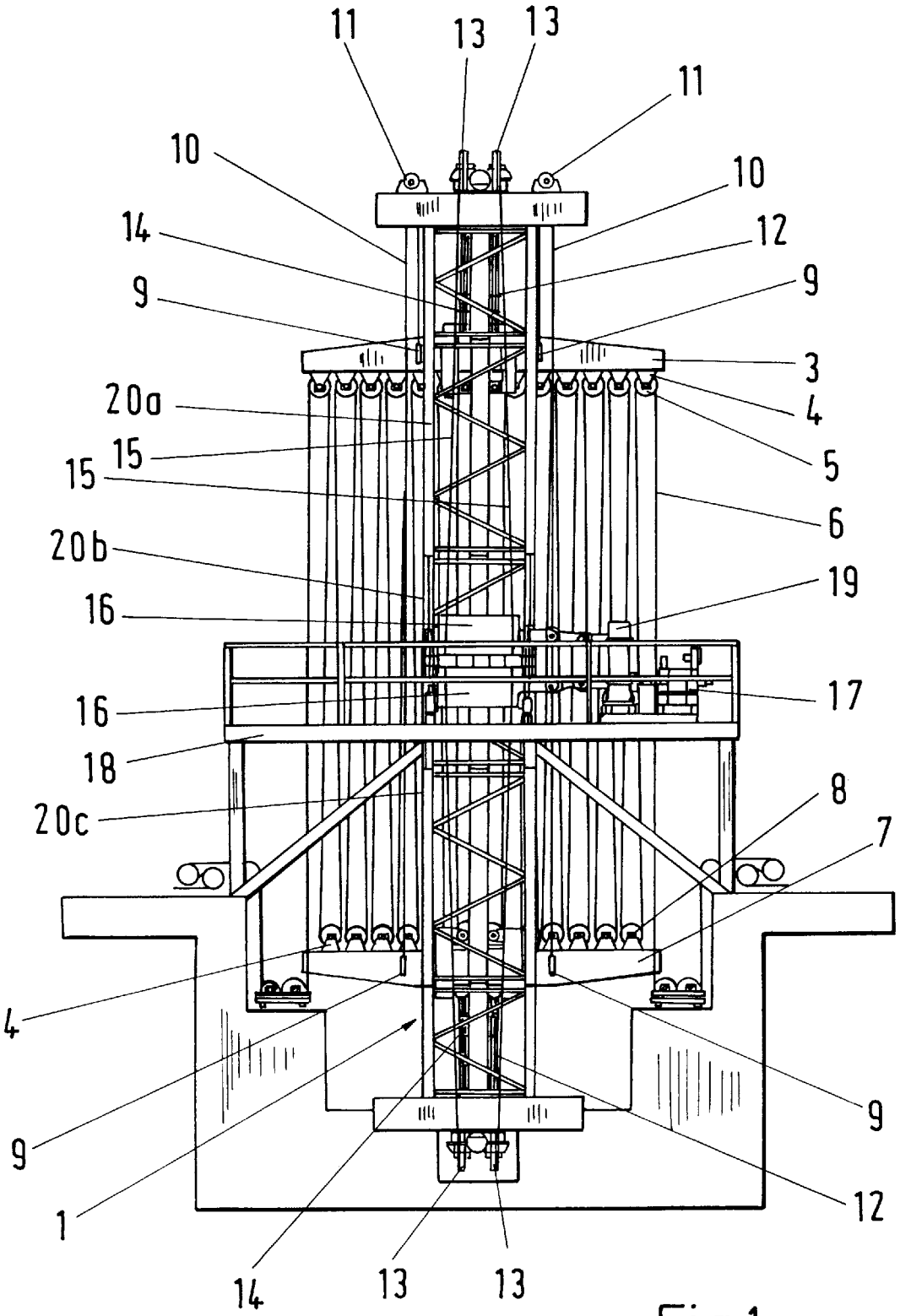
FIG. 1 is a side view of the vertical strip storage device according to an embodiment of the invention.

Referring to FIG. 1, the vertical strip storage device includes a supporting frame 1 in which an upper roller bridge 3 is movably vertically guided in an upper part of the supporting frame 1. The upper roller bridge 3 has downward projecting deflecting rollers 5 which are connected to the upper roller bridge 3 by connectors 4. A lower roller bridge 7 is movably vertically guided in the lower part of the supporting frame 1. The lower roller bridge 7 moves synchronously with the upper roller bridge 3 and carries upward directed lower deflecting rollers 8, which are also connected by connectors 4. A strip 6 is alternately reeved through the upper deflecting rollers 5 and the lower deflecting rollers 8 inside the supporting frame 1.

The inherent weights of the lower roller bridge 7 and upper roller bridge 3 are counterbalanced by a suitable coupling of the upper and lower roller bridges 3 and 7 such that they cancel one another out in practice without requiring any additional counterweights.

A coupling cable 10, or a chain, having its ends attached to each of the upper and lower roller bridges 3 and 7 by cable connectors 9 is used for coupling the upper and lower roller bridges 3 and 7. The coupling cable 10 is guided over coupling deflecting rollers 11 supported on an upper portion of the supporting frame 1, so that the roller bridges 3 and 7, given a suitable inherent weight, are balanced. When one of the roller bridges 3 and 7 is moved, the coupling cable 10 guided over the coupling deflecting rollers 11 ensures that the movements of the upper and lower roller bridges 3 and 7 are effected synchronously, but in opposite directions. In this manner, the weight of one roller bridge compensates the other such that no additional counterweights are required.

Figure 2:
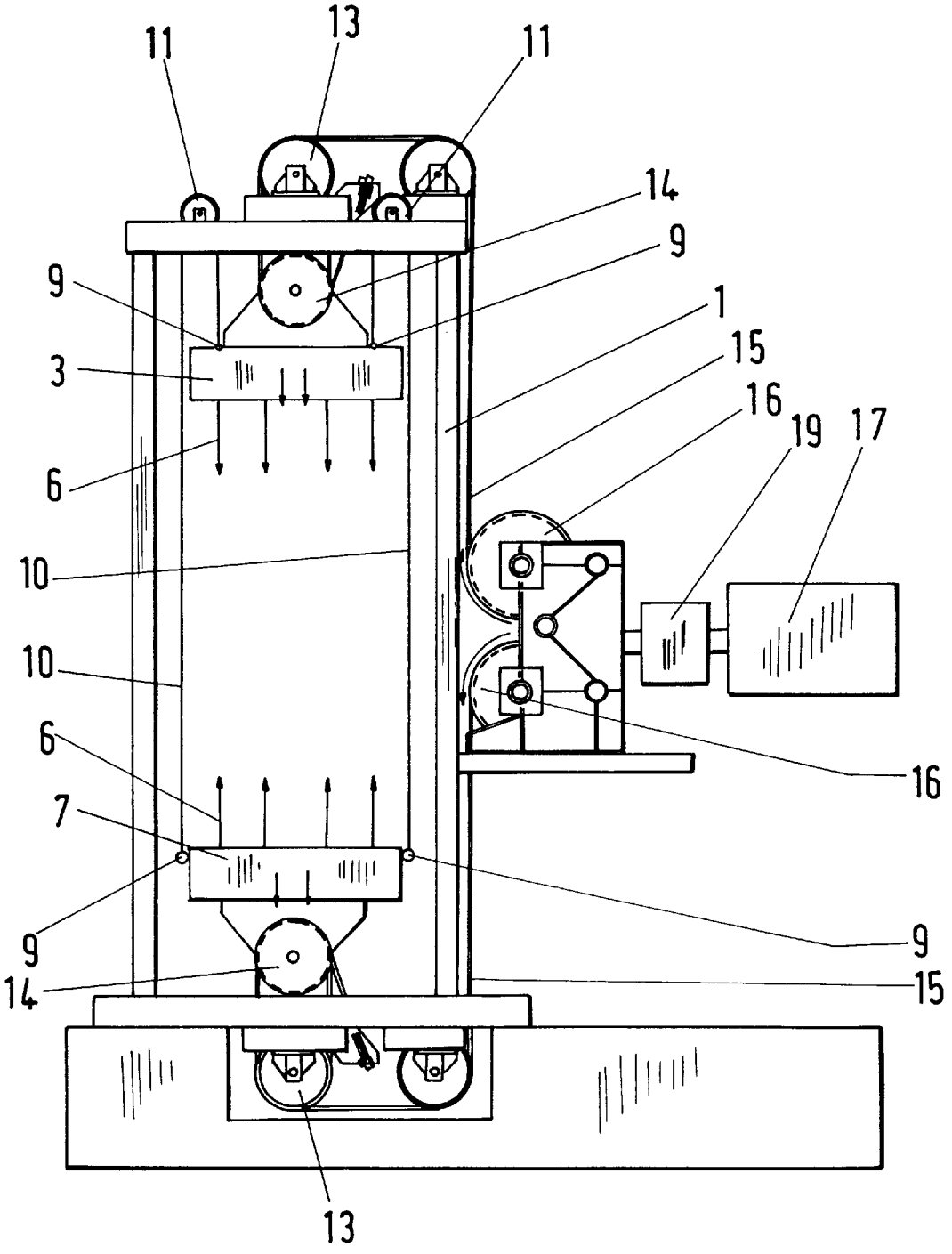
FIG. 2 is a schematic view of the strip storage, according to the embodiment of FIG. 1, as viewed from the strip running direction.

As can better be seen in the schematic view in FIG. 2, the roller bridges 3 and 7 are driven via pulley blocks 12. The pulley blocks 12 include stationary rollers 13 supported above the upper roller bridge 3 and below the lower roller bridge 7 at the supporting frame 1 and loose rollers 14 which are fastened to the respective roller bridges 3, 7. Drive cables 15 of both pulley blocks 12 are guided to cable drums 16 in each instance. The cable drums 16 are mounted together with their drive on a bracket 18 at the side of the supporting frame 1. The drive for both cable drums 16 includes a motor 17. The torque from the motor 17 is transmitted to the cable drums 16 via a differential gear unit 19 which is also part of the drive.

Referring to FIGS. 1 and 2, the supporting frame is constructed in modular fashion as a lattice tower construction and comprises standardized parts 20*a*, 20*b*, 20*c* having the same overall length.

The invention is not limited by the embodiments described above which are presented as examples only but can be modified in various ways within the scope of protection defined by the appended patent claims.

We claim:

1. A vertical strip storage device for bridging strip running interruptions in a continuous strip production, comprising:

a supporting frame forming a looping tower and having an upper end and a lower end;

an upper roller bridge movably vertically guided at the upper end of said supporting frame;

a lower roller bridge movably vertically guided at the lower end of said supporting frame;

a coupling deflecting pulley mounted on said supporting frame;

a coupling cable connecting said upper roller bridge and said lower roller bridge via said coupling deflecting pulley wherein said upper roller bridge and said lower roller bridge move synchronously and oppositely such that one of the upper and lower roller bridges acts as a counterweight for the other of the upper and lower roller bridges;

an upper pulley block comprising an upper stationary pulley assembly mounted on the upper end of said supporting frame and an upper loose pulley assembly mounted on said upper roller bridge;

a lower pulley block comprising a lower stationary pulley assembly mounted on the lower end of said supporting frame and a lower loose pulley assembly mounted on said lower roller bridge;

upper and lower cable drums rotatably mounted on the supporting frame; and upper and lower drive cables operatively connecting said upper and lower pulley blocks to said upper and lower cable drums, respectively, such that said upper and lower roller bridges move synchronously and oppositely when said cable drums are rotated.

2. The vertical strip storage device of claim 1, further comprising a motor for driving both said upper and lower cable drums.

3. The vertical strip storage device of claim 2, further comprising a differential gear unit for transmitting a driving force of said motor to said upper and lower cable drums.

4. The vertical strip storage device of claim 1, further including means for driving said upper and lower cable drums;

a bracket laterally mounted on said supporting frame for supporting said upper and lower cable drums and said means for driving; and said supporting frame being constructed as a lattice tower structure in a modular type construction.

* * * * *